United States Patent [19]

Suzuki et al.

[11] Patent Number: 4,863,049

[45] Date of Patent: Sep. 5, 1989

[54] CAP FOR A VESSEL

[75] Inventors: Issei Suzuki; Takashi Kano, both of Yamagata; Yoshio Watanabe, Kaminoyama; Noboru Anzai, Yamagata, all of Japan

[73] Assignee: Mect Corporation, Tokyo, Japan

[21] Appl. No.: 251,146

[22] Filed: Oct. 6, 1988

[30] Foreign Application Priority Data

Oct. 12, 1987 [JP] Japan ..... 62-257977

[51] Int. Cl.[4] ..... B65D 41/62

[52] U.S. Cl. ..... 215/249; 215/32; 215/DIG. 3; 220/69

[58] Field of Search ..... 215/249, 251, 32, DIG. 3; 220/269

[56] References Cited

U.S. PATENT DOCUMENTS

| | | | |
|---|---|---|---|
| 3,013,687 | 12/1961 | Gould | 215/249 |
| 3,355,058 | 11/1967 | Asbury | 220/269 |
| 3,379,326 | 4/1968 | Anderson | 215/249 |
| 4,134,511 | 1/1979 | Deussen | 215/32 |
| 4,274,543 | 6/1981 | Braymer, Jr. et al. | 215/249 |
| 4,284,199 | 8/1981 | Bigarella | 215/32 |
| 4,394,919 | 7/1983 | Von Alven et al. | 215/249 |
| 4,463,862 | 8/1984 | Hansen | 215/249 |
| 4,664,276 | 5/1987 | Taragna et al. | 215/249 |
| 4,733,784 | 3/1988 | Bennett | 215/32 |
| 4,746,017 | 5/1988 | Howard et al. | 215/249 |

FOREIGN PATENT DOCUMENTS

| | | | |
|---|---|---|---|
| 52-52853 | 12/1977 | Japan . | |
| 58-1662 | 1/1983 | Japan . | |
| 59-89855 | 6/1984 | Japan . | |
| 2101105 | 1/1983 | United Kingdom | 215/251 |

*Primary Examiner*—Stephen Marcus

*Attorney, Agent, or Firm*—Rodman & Rodman

[57] ABSTRACT

A cap of a bottle for a medical fluid having a seal stopper at an opening. The cap has a projection integrally extending from a cap body of a cap member. Around the base portion of the projection, there is formed a thin-plate portion for bending and removing the projection from the cap body with ease and safety. The thin plate comprises a continuously recessed groove.

9 Claims, 2 Drawing Sheets

CAP FOR A VESSEL

BACKGROUND OF THE INVENTION

1. Field of the Invention

The present invention relates to a cap for a vessel, particularly to an effective technology to be applied to a cap of a bottle for a medical fluid such as a so-called vial.

2. Related Art Statement

Generally, a typical example employed as a bottle for a medical fluid is a flip-off cap, a pull-top cap or a clean cap, so called.

Of these, there are the following problems in the case of a flip-off cap (cf., e.g., Japanese Utility Model Laid-Open No. 52-52853):

(a) it has a joint structure of a molded resin and pressed aluminum, and thus the cost thereof is high, (b) it is difficult to keep sanitary quality because an alien matter such as a hair tends to be caught in the joint portion, and, moreover, (c) breaking the seal of the cap is carried out by a fingertip, and thus, in such a case as in a hospital where a great amount of bottles are to be opened, the fingertip tends to be damaged, and much time is required to open them.

While, there are also many problems in the case of a pull-top cap:

(a) it should be opened with both hands, and thus it is inconvenient, and particularly, much time is required where a great amount of the caps are used, (b) a clip of the cap should be pulled upwardly with much force on breaking the seal, and thus much labor is required for the operations, and (c) a finger or the like tends to be injured by the clip after the seal breaking.

In contrast to these caps, in the case of a clean cap, the seal breaking can be done only by pushing a projection of the cap, and thus it is superb in an operational sense and convenient even when used in large quantities.

However, there also remain the following problems in the case of this structure.

That is, in the structure as disclosed in, e.g., Japanese Patent Laid-Open No. 58-1662, the lower end of the cap has a split for the removal, and when the cap is removed, a rubber stopper sealing an opening of a bottle is also removed together. Accordingly, there remain the following serious defects:

(a) once it is opened, alien matters tend to enter therein from the opening, and thus it is difficult to keep the sterility, and (b) it can be used only once because preservation of contents is difficult. Thus it is not usable in a brick test or the like where subdivision is required.

Hereupon, there is disclosed, in Japanese Utility Model Laid-Open No. 59-89855, a cup structure in which a plurality of through holes are formed in series around the base portion of a projection provided at the top side of a cap, and the projection can be removed by bending it at the portion of the through holes.

However, by this cap structure, the opening edge of the cap after removing the projection by bending becomes a sharp jagged edge owing to the alternate combination of the formed portions of the through holes and non-formed portions thereof, so that when the projection is removed by pushing and bending it with, e.g., a tip of thumb, the palm side (inside) of the thumb tends to be injured by touching the jagged edge.

Thus, there remain problems that the cap is dangerous on the seal breaking operation thereof, and inferior in its operational property.

Moreover, there also remains a serious problem that because a plurality of the through holes are formed at the top side of the cap, alien matters such as minute dust tend to enter from the through holes during preservation, and the space between the inner side of the cap and the rubber stopper is contaminated before opening.

SUMMARY OF THE INVENTION

An object of the present invention is to provide a cap for a vessel which is able to solve all the said various problems, and sanitary, and superb in the operational sense.

The cap for a vessel of the present invention is provided with a continuous thin-plate portion, for bonding and removing the projection safely and easily from a cap body continuously, around the base portion of the projection integrally and vertically extending from the cap body of a cap member.

In using the cap for a vessel of the present invention, the projection can be removed from the cap body with safety and ease merely by pushing the projection by hand. Moreover, when the depth of the thin-plate portion is arranged uniformly, the bent edge of the projection does not become a sharp and jagged edge, so that the formation of a fin after the bending removal of the projection can be prevented and the injury of the finger can be avoided. The cap has no through holes, and thus alien matters do not enter in the space between the inner side of the cap and sealing stopper, preventing contamination before opening of the stopper. Additionally, the sealing stopper is not removed even after opening so that the medical fluid in the bottle can be kept sanitary even after opening.

BRIEF DESCRIPTION OF THE DRAWINGS

The above and other objects and features of the present invention will become more apparent when referred to the following descriptions given in conjunction with the accompanying drawings, wherein like reference numerals denote like elements, and in which.

DETAILED DESCRIPTION OF THE PREFERRED EMBODIMENT

Figure 1:
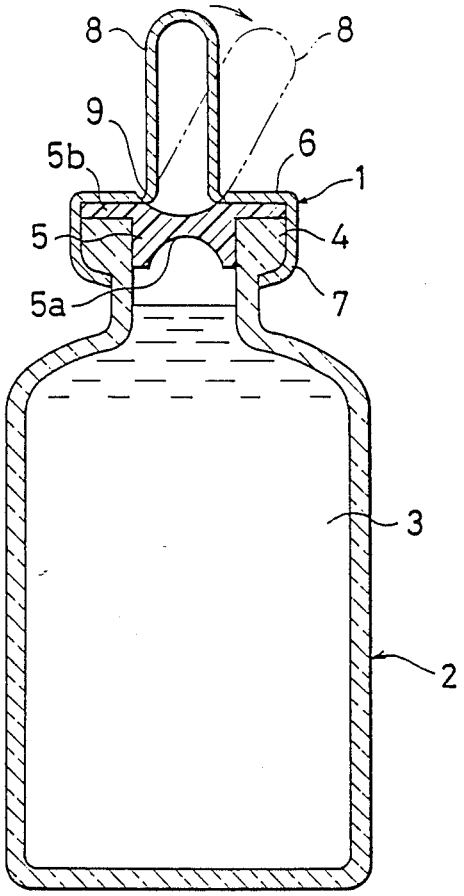
FIG. 1 is a cross-sectional view of a bottle for a medical fluid having thereon a cap which is an example of the present invention.

Referring to the drawings, a cap 1 for a vessel of the present invention is exemplarily applied to sealing of a bottle 2 of a medical fluid.

In the bottle 2, a predetermined amount of a medical fluid 3 is contained with a seal. Around the distal end of the opening 4 of the bottle 2, a sealing stopper 5 of, e.g., rubber is attached so as to seal and shut off the inside of the bottle 2 from the outside thereof.

A thin-plate portion 5*a* is formed in a substantially central portion of the seal stopper 5, and thus the thin plate-portion 5*a* is pierced with ease by an injection needle or the like.

The opening 4 of the bottle 2 and the seal stopper 5 are covered with the cap 1 so as to prevent a natural removal of the seal stopper 5 before opening, and contamination of alien matters.

The cap 1 for a vessel is formed as a cap member integrally made of a metal material such as aluminum in this example, and includes a substantially plane cap body 6 for grasping and fixing a flange portion 5*b* of the seal stopper 5 to the top side of the opening 4 of the bottle 2, a fixing portion 7 for fixing the cap 1 to the opening 4 of the bottle 2 by extending downwardly from the outer edge of the cap body 6, covering the outer side of the opening 4 of the bottle 2, and being clinched inwardly at the lower end thereof, and a cylindrical projection 8 with a round head extending upwardly by a predetermined length from a substantially central portion of the cap body 6.

On breaking the seal of the bottle 2, the projection 8 is to be bent and removed by pushing the projection 8 with, e.g., the inside of a thumb.

In order to carry out the bending removal of the projection 8 with ease and safety, in this example, a thin-plate portion 9 formed at a base portion of the projection 8 in the form of a recessed groove by, e.g., half-pressing the material of the cap body 6 continuously in the shape of a circular ring similar to the horizontal cross-sectional shape of the projection 8.

The thin-plate portion 9 is not through the material of the cap body 6, and thus alien matters are completely prevented from entering into the inside of the cap 1 from the thin-plate portion 9.

The thin-plate portion 9 is formed so as not to make a fin at the bent edge thereof that becomes ruptured on bending removal of the projection 8. As shown in FIG. 2*b*, the cap body 6 has a declining portion 6*a* at the base portion of the projection 8, and the thin-plate portion 9 is the boundary portion between the inner edge 6*c* (indicated by the dotted line in FIG. 2*b*) of the declining portion 6*a* and the projection 8. The thin plate portion 9 is formed by half-pressing to provide a tapered section 9*b* of decreasing thickness up to the point of intersection between the thin plate section 9 and the projection 8.

Thus, a fin is not made at the bent edge even on the bending removal of the thin-plate portion 9, and the bent edge is recessed at a lower position than a top face of the cap body 6, so that a worker can avoid inquiry at his fingertip.

Figure 2A:
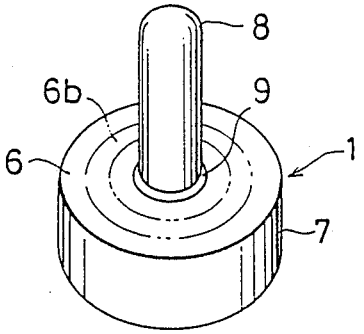
FIG. 2*a* and 2*b* show respectively a perspective view of the cap and a expanded partially sectional view of a thin-plate portion thereof.
Figure 2B:
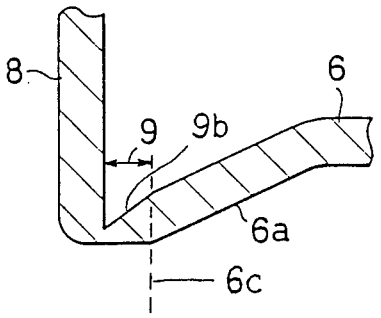

The outer surface of the cap body 6 can be used as a display portion 6*a* for displaying a name of article or maker, production number and/or marks by stamping or sealing as shown by two-dot chain line in FIG. 2*a*.

Hereinafter, the operation of the example of the present invention will be described.

The cap 1 for a vessel is formed as shown in FIGS. 2*a* and 2*b* by pressing of a metal material in advance. At that time, the thin-plate portion 9 for the bending removal is formed simultaneously by half-pressing at the base portion of the projection 8.

Then, the medical fluid 3 is poured into the bottle 2. Thereafter, the seal stopper 5 is fitted into the opening 4, and further the cap 1 is attached thereon, and the lower end of the fixing portion 7 is clinched inwardly to fix the cap 1 to the opening 4 of the bottle 2 and grasp the flange portion 5*b* of the seal stopper 5 between the top side of the opening 4 and the lower side of the cap body 6.

When the bottle 2 is opened by breaking the seal thereof in order to take out the medical fluid in the bottle 2 provided with the seal stopper 5 and the cap 1, the bottle 2 is grasped by a hand, and for example, the projection 8 is pushed along two-dot chain line from the position of solid line in FIG. 1 with pressing the vicinity of the upper portion of the projection 8 of the cap 1 by the palm side of the thumb.

As the result, the projection 8 is easily ruptured away at the thin-plate portion 9 of the base portion thereof, and removed from the cap body 6 at the thin-plate portion 9 in single movement.

At that time, as the thin-plate portion 9 is formed as a continuously recessed groove, the remained bent edge in the side of the cap body 6 on the bending removal of the projection 8 does not become a sharp and jagged edge, but a smooth and continuous edge. Accordingly, there can be avoided the danger of injuring a fingertip on breaking the seal, and the seal breaking can be carried out rapidly, easily and safely with single movement operation by one hand.

Even after the bending removal of the projection 8 from the cap body 6, the seal stopper 5 remains to be held at the opening 4 of the bottle 2 by the cap body 6 and fixing portion 7, so that there is no possibility that alien matter can enter the bottle 2 by the seal breaking.

While, when the medical fluid 3 in the bottle 2 is taken out, the medical fluid 3 can be taken out easily in sanitary conditions by piercing, e.g., an injection needle into the thin-plate portion 5*a* of the seal stopper 5.

Other Examples

FIGS. 3, 4, 5, 6 and 7 are perspective views respectively indicating other various examples of the cap for a vessel according to the present invention.

Figure 3:
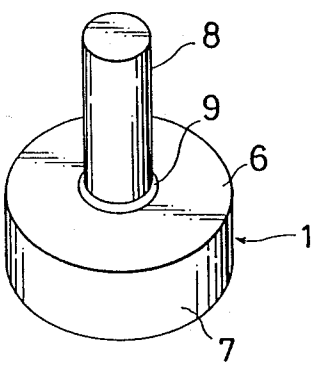
FIGS. 3, 4, 5, 6 and 7 are perspective views respectively indicating other various examples of the cap for a vessel according to the present invention.

An example shown in FIG. 3 is similar to the examples in FIGS. 1, 2*a* and 2*b*, however, the projection 8 thereof is formed in a substantially cylindrical shape, and the distal end thereof is not in the form of a round head, but a flat head.

Figure 4:
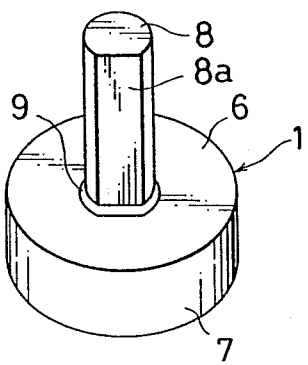

An example shown in FIG. 4 is similar to the example in FIG. 3, however, one side of the projection 8 thereof is formed in a flat face to be pressed by a thumb on the flat portion 8*a*.

In this case, the thin-plate portion 9 is also formed in the same shape as the horizontal cross section of the projection 8 by half-pressing.

Figure 5:
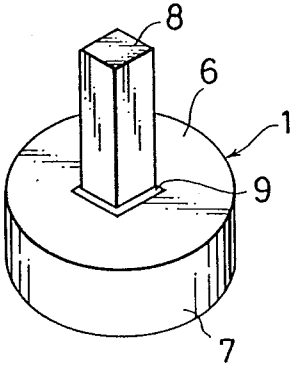

FIG. 5 shows another example in which the projection 8 is formed in the shape of a square pillar, and the thin-plate portion 9 is also formed in the shape of a square and continuously recessed groove as similar to it.

Figure 6:
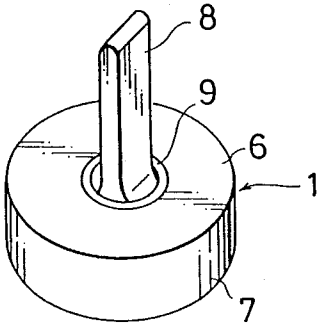

FIG. 6 shows still another example in which the projection 8 is formed generally in a flat pillar shape.

Figure 7:
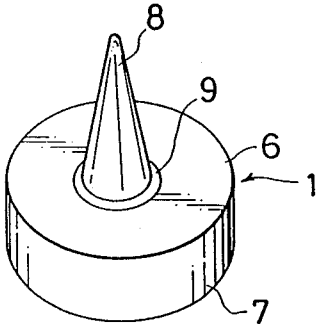

FIG. 7 shows still another example in which the projection 8 is formed in a conical shape.

In any case of FIGS. 3 through 7, the projection 8 can be bent and removed with ease from the cap body 6 at the thin-plate portion 9 only by a light pressing by a finger.

The present invention is not limited to the above-described examples, but the other various modifications are possible.

For example, the cap 1 for a vessel may be made of any other metal materials than aluminum, or of synthetic resin, and the thin-plate portion 9 may be suitably formed by any given method such as molding other than half-pressing.

Moreover, the shapes of the projection 8 may be ones other than those as described above. Particularly, when it is in the form which makes possible to be pressed in any given direction, the bending removal of the projection can be carried out with ease.

Additionally, it can be easily colored, for example, by plating when the cap 1 is made of a metal, or by addition of pigment when made of synthetic resin. Accordingly, identification of the kind of articles by the color of a cap is possible.

The present invention can be widely applied as caps for various vessels such as those of powder or freeze-dry articles other than the bottles for medical fluids.

(a) According to the present invention, in the cap for a vessel having the seal stopper at the opening thereof, the cap has the cap member covering the said opening and seal stopper from the outside thereof, the projection extends integrally and outwardly from the substantially central portion of the cap body of the cap member, the thin-plate portion for bending and removing the projection from the cap body of the cap member is continuously formed around the base portion of the projection, the said seal stopper keeps the sealing of the said opening even after the bending removal of the said projection from the said cap body, and thus, the seal breaking of the cap can be carried out in single movement, rapidly and easily. Moreover, the formation of a fin at the bent edge of the thin-plate portion can be prevented, and thus the formation of the dangerous and sharp jagged edge can be avoided, so that the seal breaking can be carried out safely without injuring a fingertip.

Particularly, the prevention of an incision by the present invention is extremely effective as a countermeasure against a medical accident such as a death of B type hepatitis or AIDS infectious inside a hospital, these accident being serious problems recently.

(b) Through holes are not formed at the base portion of the projection so that there can be certainly prevented the contamination caused by entering of alien matters such as dust into the space between the inner side of the cap and the seal stopper during preservation before the seal breaking, and the outside of the seal stopper can be also kept sanitary.

(c) The seal stopper is not dropped away from a vessel even after the seal breaking so that the inside and outside of the vessel are certainly separated by the seal stopper, and thus the sanitation condition can be kept preferable.

(d) Owing to the extension of the projection, the seal breaking can be carried out easily with small force. Particularly, it is extremely suitable for the seal breaking of a great amount of vessels. Further the vessel can be taken out from a box or the like by pinching the projection.

(e) By forming the whole body of the cap integrally with a single material such as metal or synthetic resin, the cap can be produced and processed at low cost.

(f) Restoration to the original state is impossible once the bending removal of the projection is done, and thus an alteration can be prevented.

What is claimed is:

1. A closure for a vessel having an opening comprising, (a) a seal stopper at said opening, said seal stopper having a first outside surface portion, (b) a cap member covering said seal stopper at the outside surface, said cap member having an engagement portion in surface contact with said first outside surface portion, said engagement portion having a predetermined thickness, said cap member further having an integral projection extending away from the engagement portion, a thin plate portion extending from the engagement portion around the projection to join the projection to said engagement portion, said thin plate portion being of lesser thickness than the engagement portion to facilitate removal of said projection from said engagement portion of said thin plate portion upon deflection of said projection a predetermined amount with respect to said engagement portion, said engagement portion, in cross section, at the area of said thin plate portion declining toward said thin plate portion and said first outside surface portion and said thin plate portion being tapered and having a decreasing thickness in a direction from the engagement portion to the projection such that deflection and removal of the projection from the engagement portion at said thin plate portion exposes a declined and tapered edge portion, declined and tapered toward said first outside surface portion, said declined and tapered edge portion being in continuous contact against said first outside surface portion, to inhibit the declined and tapered edge portion from functioning as a cutting edge to cause injury.

2. A closure according to claim 1 wherein said engagement portion includes an elevated section elevated above the thin plate section such that the declined edge portion is recessed below said elevated section.

3. A closure according to claim 2 wherein a continuous declining portion is provided between the elevated section of said engagement portion and said thin plate section to establish an uninterrupted fairing between said elevated section and said thin plate section.

4. A closure according to claim 1 wherein said thin plate portion is a continuously recessed groove.

5. A closure according to claim 1 wherein said seal stopper extends across said opening such that said engagement portion maintains surface contact with the first outside surface portion of said seal stopper after said projection is removed from said engagement portion.

6. A closure according to claim 1 wherein said thin plate portion at said area of lesser thickness has an inner surface in substantial surface to surface contact with said first outside surface portion, and an outer surface that converges toward said inner surface.

7. A closure according to claim 1 wherein said cap member is formed integrally with a single metallic material.

8. A closure according to claim 1 wherein said cap member is formed integrally with a single material of synthetic resin.

9. A closure according to claim 1 wherein said vessel is a bottle for a medical fluid.

* * * * *